US005740910A

United States Patent [19]

Ueng

[11] Patent Number: 5,740,910

[45] Date of Patent: Apr. 21, 1998

[54] TOOL BOX

[76] Inventor: Gaw-Gwo Ueng, P.O. Box 82-144, Taipei, Taiwan

[21] Appl. No.: 709,654

[22] Filed: Aug. 26, 1996

[51] Int. Cl.[6] ..... A47B 81/00; B65D 85/00

[52] U.S. Cl. ..... 206/373; 211/70.6; 211/169; 312/902

[58] Field of Search ..... 206/372, 373; 211/70.6, 169; 312/902

[56] References Cited

U.S. PATENT DOCUMENTS

| | | | |
|---|---|---|---|
| 1,380,861 | 6/1921 | Belair | 211/169 |
| 3,379,484 | 4/1968 | Kling | 211/169 |
| 3,391,796 | 7/1968 | Cross | 211/169 |
| 4,170,392 | 10/1979 | Spevak | 206/373 |
| 4,255,872 | 3/1981 | Williams, Sr. | 206/373 |
| 4,273,394 | 6/1981 | Chandler | 206/373 |
| 4,286,832 | 9/1981 | Spevak | 206/373 |
| 4,339,164 | 7/1982 | Spevak | 206/373 |
| 5,139,155 | 8/1992 | Laxson | 211/169 |

*Primary Examiner*—Jimmy G. Foster
*Attorney, Agent, or Firm*—Alfred Lei

[57] ABSTRACT

A tool box including a rectangular container having a rear wall and two side walls, an upper elongated angular member fixedly mounted on an upper portion of the rear wall, a lower elongated angular member fixedly mounted on a lower portion of the rear wall, a plurality of vertically disposed rectangular panels having a vertical edge pivotally connected between the upper and lower elongated angular members and formed with a plurality of recesses each on an upper edge close to an upper outer corner thereof and a plurality of holes thereon, a positioning rod extending through the two side walls and engaged with the recesses, and a plurality of hooks detachably fitted in the holes respectively, whereby the tools in the tool box are easily accessible than in conventional tool boxes.

4 Claims, 7 Drawing Sheets

TOOL BOX

BACKGROUND OF THE INVENTION

1. Field of the Invention

This invention is related to a tool box and in particular to one for holding hand tools such as screwdrivers and wrenches and other associated items that may be needed by the user from time to time.

2. Description of the Prior Art

It has been found that tool boxes of the type referred to above are well known in the art and commonly used by handicraftsmen and/or servicemen. Such boxes are generally in the form of an elongated rectangularly shaped container having a bottom wall, a back wall, a front wall, a pair of side walls and a cover which is usually hinged to the back wall and which is usually includes a handle so that the tool box can be easily moved from one location to another. Usually, one or more trays are disposed inside the container. In some tool boxes the trays are removable while in other tool boxes the trays are pivotally mounted so that they can be partially lifted out to gain access to the storage area underneath. Though the trays are normally divided into compartments, the size of the compartments is frequently not the proper size needed for the specific items the user wishes to place in the trays. Furthermore, the space between the trays and the bottom wall is not constructed such that the tools can be arranged in an orderly manner. As the tools are not arranged in an orderly manner, the user is forced in many cases to remove most all of the tools in the bottom area until he finds the particular tool needed at a particular time. However, this is very time consuming and often very frustrating.

Therefore, it is an object of the present invention to provide an improved tool box which can obviate and mitigate the above-mentioned drawbacks.

SUMMARY OF THE INVENTION

This invention relates to an improved tool box.

It is the primary object of the present invention to provide a tool box in which the tools are easily accessible than in conventional tool boxes.

It is another object of the present invention to provide a tool box in which the tools are arranged in an orderly manner.

It is still another object of the present invention to provide a tool box which can be rapidly assembled.

It is another object of the present invention to provide a tool box which is easy to use.

It is a further object of the present invention to provide a tool box which is inexpensive to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
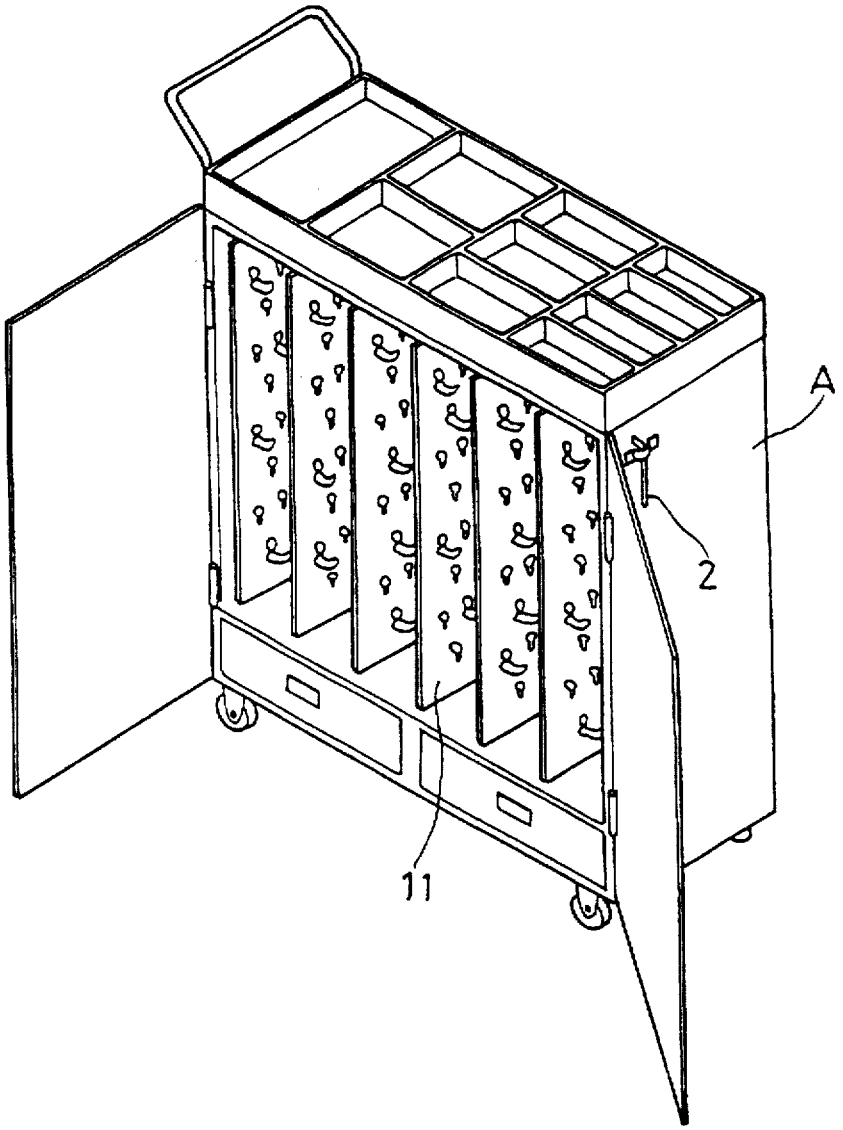
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIGS. 1, 2, 2A and 2B thereof, the tool box according to the present invention comprises a container A, a positioning rod 2, an upper elongated angular member 12, a lower elongated angular member 13, a plurality of vertically disposed rectangular panels 11, and a plurality of hooks 3.

The container A is generally rectangular in shape and provided with castors (shown but not numbered) at the bottom. The upper and lower elongated angular members 12 and 13 are fixedly mounted on the upper and lower portions of the rear wall of the container A, respectively.

Figures 2, 2A, 2B:
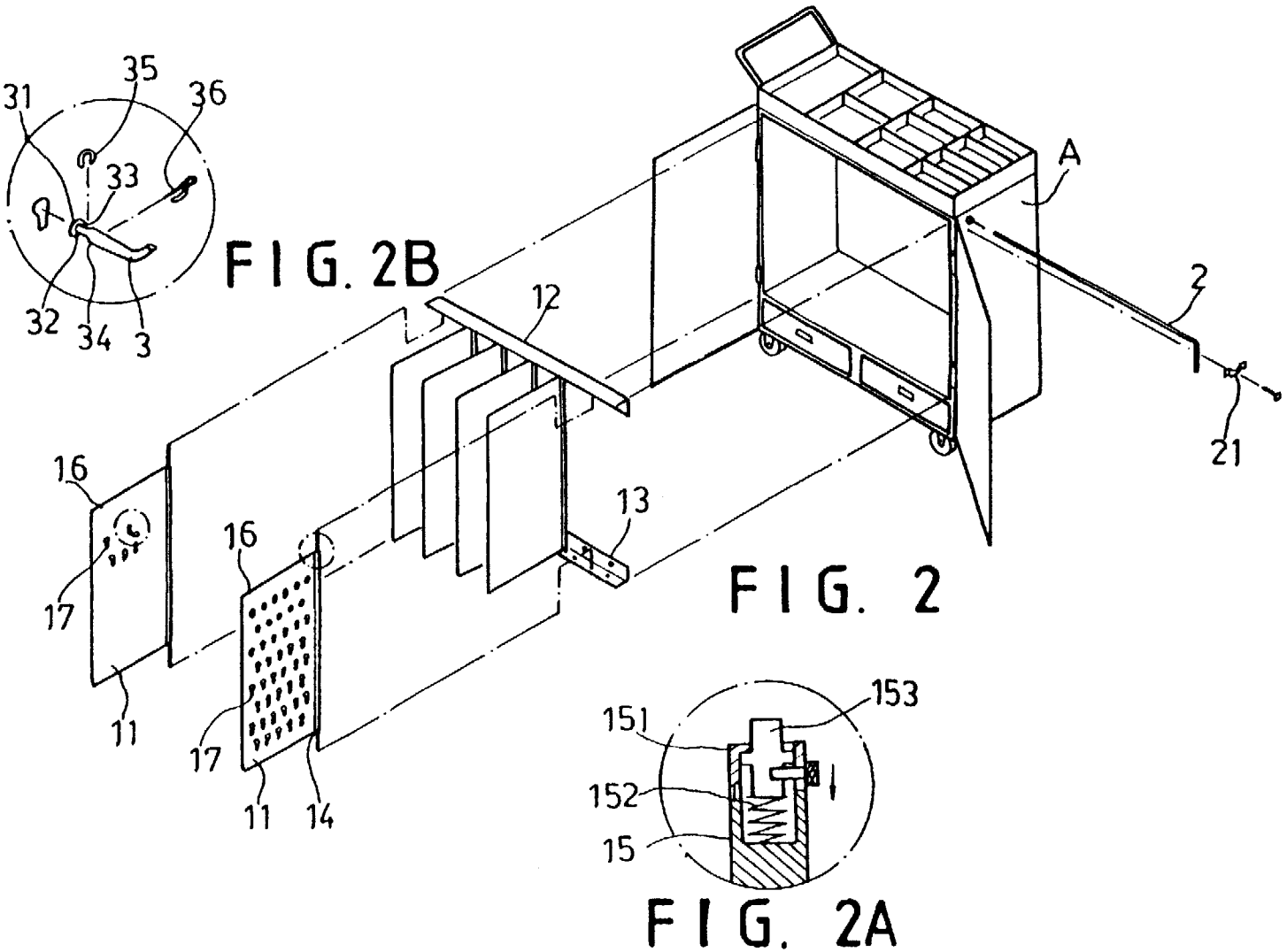
FIG. 2 is an exploded view of the present invention.
FIG. 2A is a sectional view showing the spring-loaded pin of the rectangular panel.
FIG. 2B is an exploded view of the hook.
Figure 3A:
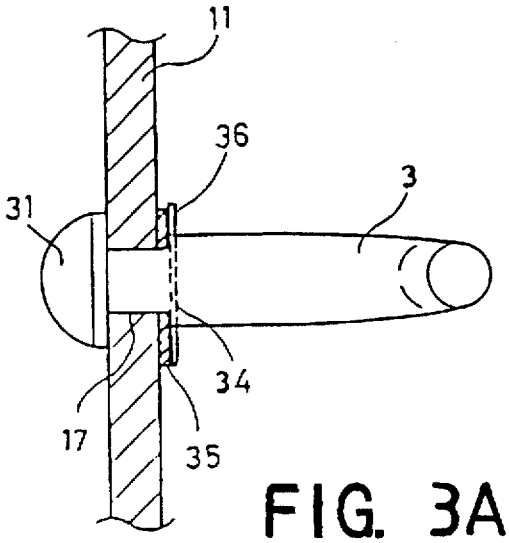
FIG. 3A is a sectional view illustrating the engagement between the hook and the panel.
Figure 3B:
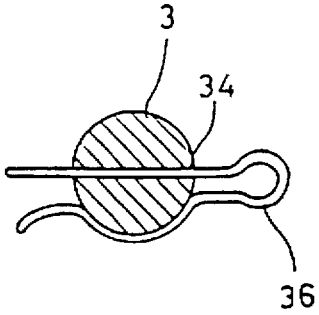
FIG. 3B is a sectional view illustrating how the locking pin is engaged with the hook.

The upper and lower elongated angular members 12 are provided with a plurality of perforations. The vertically disposed rectangular panels 11 are pivotally fitted between the upper and lower elongated angular members 12 and 13 at a rear vertical edge. The rear vertical edge of each of the rectangular panels 11 is provided at the lower end with a protuberance 14 engageable with a respective perforation of the lower elongated angular member 13 and at the upper end with spring-loaded means engageable with a respective perforation of the upper elongated angular member 12. As shown in FIG. 2A, the spring-loaded means includes a cavity 15 at the upper end of the rear vertical edge of the rectangular panel 11, a pin 153 arranged in the cavity 15, a spring 152 fitted under the pin 153 in the cavity 15 thereby urging the pin 153 to go upwardly, a cap 151 fixedly fitted in the cavity 15 of the rectangular panel 11 for preventing the pin 153 from disengaging from the rectangular panel 11, and a bolt extending through the cap 151 to engage with the pin 153. The rectangular panel 11 has a recess at the upper edge close to its front vertical edge and a plurality of holes 17 thereon.

The positioning rod 2 is designed for extending through the rectangular container A to engage with the recesses of the rectangular panels 11 in order to keep the rectangular panels in position. The positioning rod 2 has a vertical handle adapted to engage with a resilient engaging member 21 fixedly installed on one outer side of the rectangular container A. The resilient engaging member 21 may be of any conventional design well known to the art and is not considered a part of the invention. When in use, it is only necessary to disengage the vertical handle from the resilient engaging member 21 and then pull the positioning rod 2 out of the rectangular container A.

Figure 4:
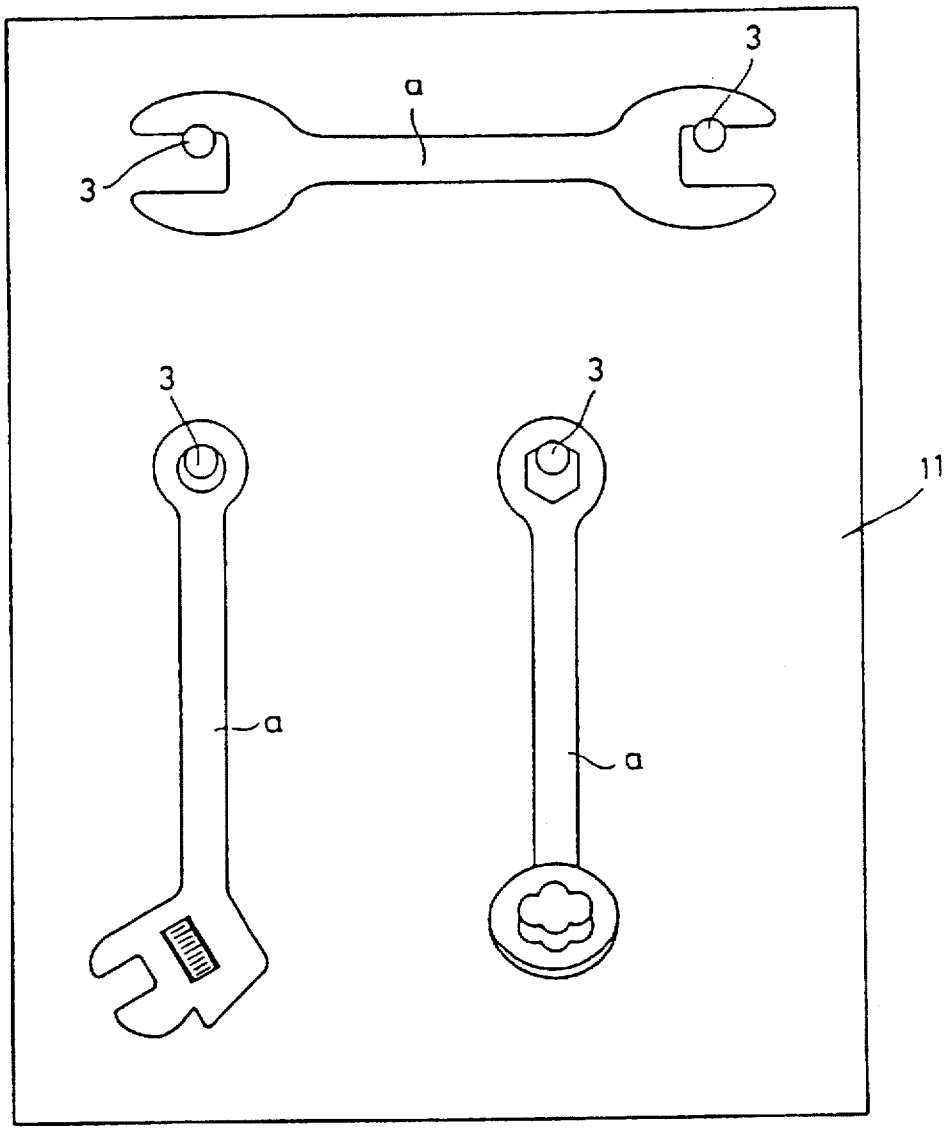
FIG. 4 illustrates how hand tools are supported by the hooks.

The hook 3 is formed with an enlarged head portion 31 at one end, a curved portion at the other end, a neck portion between the enlarged head portion 31 and the curved portion and having two opposite walls 32 and 33, and a hole 34 extending through the curved portion and located close to the neck portion. The enlarged head portion of the hook 3 is forced into the hole 17 of the rectangular panel 11. A retainer pin 36 is inserted through the hole 34 of the hook 3 for preventing the hook 3 from disengaging from the rectangular panel 11. A packing 35 is fitted between the neck portion of the hook 3 and the rectangular panel 11 for strengthening the engagement between the hook 3 and the rectangular panel 11. FIG. 4 illustrates how hand tools (a) are supported by the hooks 3.

Figure 5:
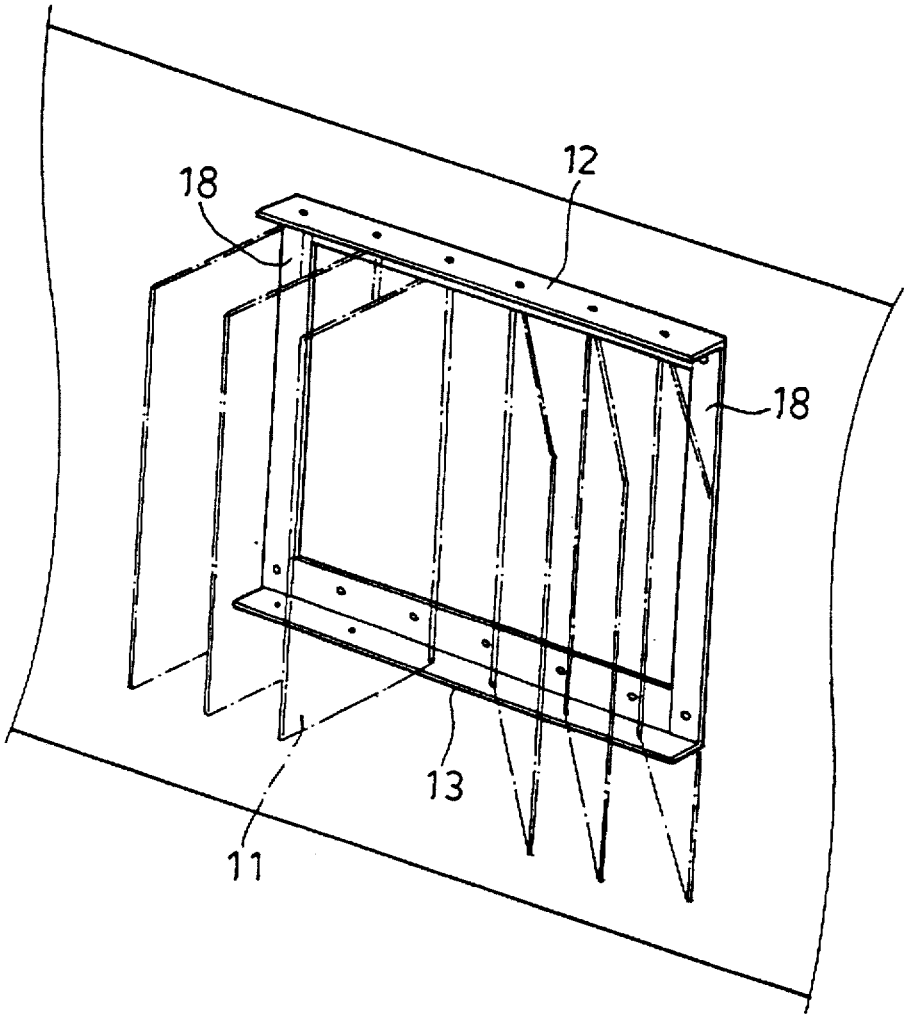
FIG. 5 shows another preferred embodiment of the present invention.

A second preferred embodiment of the present invention is shown in FIG. 5. As illustrated, two support members 18 are mounted between the upper and lower elongated angular members 12 and 13 for reinforcing the structure of the present invention.

Figure 6:
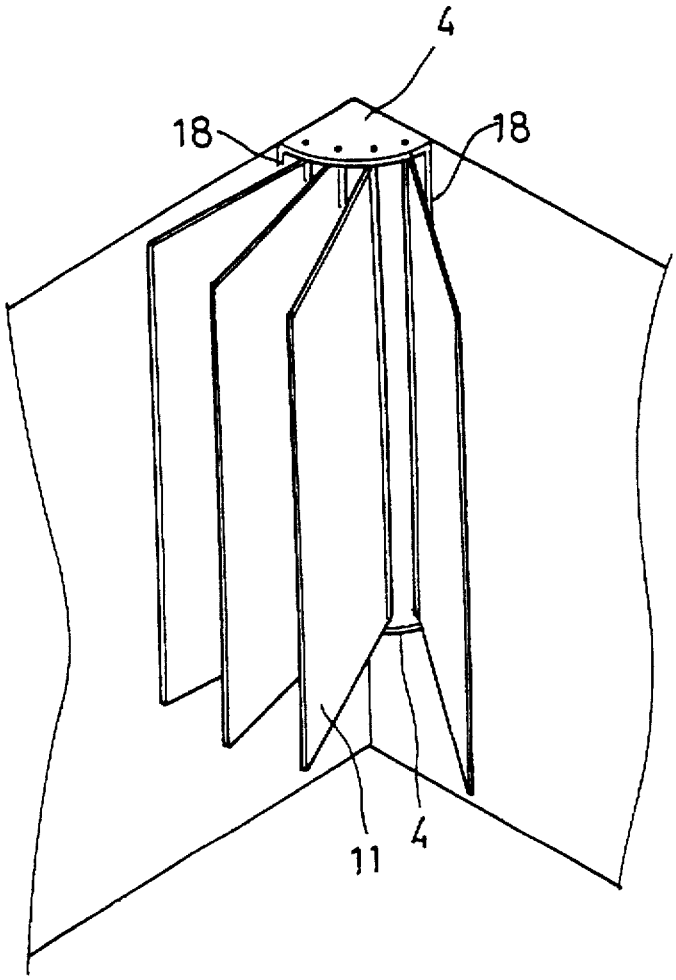
FIG. 6 shows a third preferred embodiment of the present invention.

FIG. 6 shows a third preferred embodiment of the present invention, wherein the upper and lower elongated angular members 12 and 13 are replaced with two sectorial members between which are pivotally mounted the vertically disposed rectangular panels 11.

Figure 7:
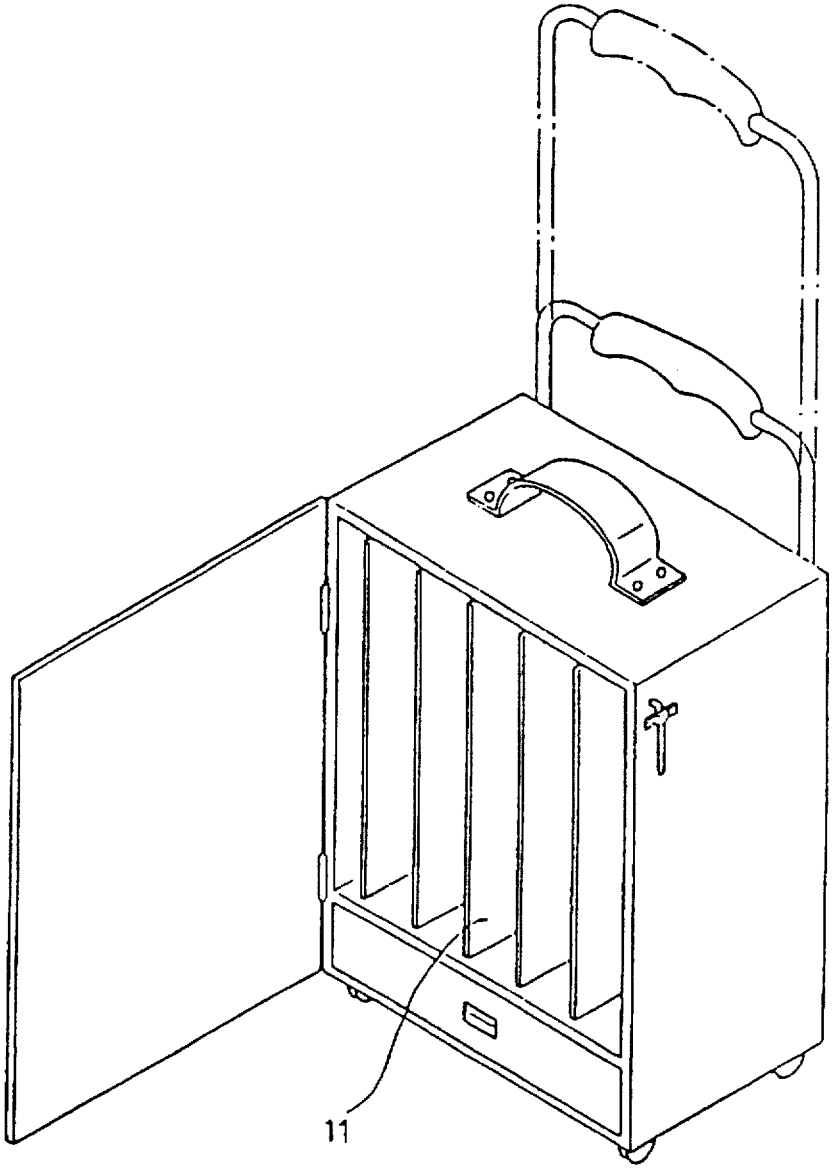
FIG. 7 shows a fourth preferred embodiment of the present invention.

FIG. 7 shows a fourth preferred embodiment of the present invention. As shown, the vertically disposed rectangular panels 11 are pivotally mounted within a rectangular container with an extensible handle.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A tool box comprising:

a rectangular container having a rear wall and two side walls;

an upper elongated angular member fixedly mounted on an upper portion of said rear wall;

a lower elongated angular member fixedly mounted on a lower portion of said rear wall;

a plurality of vertically disposed rectangular panels having a vertical edge pivotally fitted between said upper and lower elongated angular members and formed with a plurality of recesses each on an upper edge close to an upper outer corner thereof and a plurality of holes thereon;

a positioning rod extending through said two side walls and engaged with said recesses; and a plurality of hooks detachably fitted in said holes respectively.

2. The tool box as claimed in claim 1, wherein said vertical edge of said rectangular panels is provided at a lower end thereof with a protuberance engageable with a perforation of said lower elongated angular member and at an upper end thereof with a spring-loaded pin engageable with a perforation of said upper elongated angular member.

3. The tool box as claimed in claim 1, further comprising two reinforcing support members mounted between said upper and lower elongated angular members.

4. The tool box as claimed in claim 1, wherein said upper and lower elongated angular members are replaced an upper and lower sectorial members between which are pivotally mounted said vertically disposed rectangular panels.

* * * * *